US005994837A

United States Patent [19]

Willems et al.

[11] Patent Number: 5,994,837

[45] Date of Patent: Nov. 30, 1999

[54] ELECTRODELESS LOW-PRESSURE MERCURY DISCHARGE LAMP

[75] Inventors: Michel J. M. Willems; Alphons M. Klaassen; Paulus A. M. Vermeulen, all of Turnhout, Belgium

[73] Assignee: U.S. Philips Corporation, New York, N.Y.

[21] Appl. No.: 09/013,542

[22] Filed: Jan. 26, 1998

[30] Foreign Application Priority Data

Jan. 27, 1997 [EP] European Pat. Off. ..... 97200214

[51] Int. Cl.[6] ..... H01J 61/28

[52] U.S. Cl. ..... 313/550; 313/490; 313/493; 313/565; 315/344; 315/248

[58] Field of Search ..... 313/550, 556, 313/564, 565, 490, 607, 234; 315/248, 344

[56] References Cited

U.S. PATENT DOCUMENTS 5,500,567 3/1996 Wilson et al. ..... 313/490
5,559,392 9/1996 Cocoma et al. ..... 313/490
5,598,069 1/1997 van Os et al. ..... 315/248
5,783,912 7/1998 Cocoma et al. ..... 315/248

FOREIGN PATENT DOCUMENTS 19534686 4/1996 Germany ..... H01J 65/04

*Primary Examiner*—Ashok Patel
*Attorney, Agent, or Firm*—F. Brice Faller

[57] ABSTRACT

A light-transmitting discharge vessel (10) encloses a discharge space (11) in a gastight manner. The discharge space comprises mercury as well as one or several inert gases. The lamp is in addition provided with an electric coil (20) for generating a high-frequency magnetic field in the discharge space. The discharge lamp is provided with an auxiliary amalgam (40) which is provided on an elongate carrier (41) which is mechanically coupled to a tube (50) which issues into the discharge space. The auxiliary amalgam (40) covers the carrier (41) at least substantially entirely.

13 Claims, 6 Drawing Sheets

ELECTRODELESS LOW-PRESSURE MERCURY DISCHARGE LAMP

BACKGROUND OF THE INVENTION

The invention relates to an electrodeless low-pressure mercury discharge lamp provided with a light-transmitting discharge vessel which encloses a discharge space in a gastight manner, which discharge space contains mercury and one or several inert gases. The lamp is in addition provided with an electric coil for generating a high-frequency magnetic field in the discharge space, and an auxiliary amalgam which is applied to an elongate carrier which is mechanically coupled to a tube issuing into the discharge space.

Such an electrodeless low-pressure discharge lamp, also referred to as lamp in the present description and claims, is known from DE 195 34 686 to which U.S. Pat. No. 5,847,508 corresponds. The auxiliary amalgam serves to cause the mercury pressure in the discharge vessel to rise quickly up to a value desired for nominal operation after the lamp has been switched on. It is the task of a main amalgam to maintain this value during nominal operation. A desired objective is that the light output should reach a value of at least 70% of the value obtaining during nominal operation within 60 s. Any temporary drop in the light output preferably amounts to no more than 20%. In the known lamp, the auxiliary amalgam is provided on a comparatively small portion adjacent the end of a cylindrically rolled metal wiring net. The cylinder formed thereby has a further, comparatively small portion coated with a main amalgam adjacent the opposite end. In another embodiment, the carrier is a metal strip. This construction, where the carrier of the auxiliary amalgam is fastened in the tube by means of frictional forces, is attractive because of the simplicity with which the carrier can be assembled together with the lamp. It is a disadvantage of the known lamp, however, that the auxiliary amalgam must be provided individually on each carrier.

SUMMARY OF THE INVENTION

It is an object of the invention to provide an electrodeless low-pressure discharge lamp which has a construction.

The auxiliary amalgam covers the carrier at least substantially entirely. The inventor has found that the presence of the auxiliary amalgam over (substantially) the entire carrier does not adversely affect the behaviour of the lamp. The material from which the carrier is manufactured, for example metal tape, may be coated in a flow process with an amalgam or with an amalgam former, for example a metal such as bismuth, lead, or tin, or an alloy of such metals. The coating process may take place, for example, through immersion in a bath containing the amalgam former in the liquid state. Alternatively, the coating may take place, for example, electrolytically. A plurality of carriers may subsequently be easily manufactured in that portions are separated from the coated material, for example by cutting, and in that these are bent into the desired shape. If the carrier is coated with an amalgam former, the latter will form an auxiliary amalgam inside the finished lamp with the mercury vapour present therein. A small portion of the carrier may be free from amalgam, for example the end faces which the carrier has been given owing to the separation process.

In a practical embodiment, the tube and the elongate carrier are mechanically coupled in that the elongate carrier has a bend portion which is enclosed inside the tube. A favourable embodiment is characterized in that the elongate carrier is fastened in the tube by frictional forces. The carrier as a result occupies a fixed position inside the discharge vessel, so that the lamp behaviour is less dependent on the burning position.

The elongate carrier may be entirely enclosed in the tube. The temperatures prevailing in the tube, however, may be comparatively low compared with those in the discharge space. It may take a comparatively long time then before the auxiliary amalgam has released sufficient mercury. In an attractive embodiment of the electrodeless low-pressure discharge lamp according to the invention, the carrier projects from the tube into the discharge space. The auxiliary amalgam present on the portion of the carrier which lies in the discharge space is heated quickly owing to the presence thereof in the discharge space. In addition, the tube then does not hamper the spread of the mercury released by the auxiliary amalgam through the discharge space.

A practical embodiment of the electrodeless low-pressure mercury discharge lamp according to the invention is characterized in that the auxiliary amalgam is an alloy of mercury and indium. Indium has the advantage that it can bind comparatively much mercury, so that the carrier need have only a small surface area. Preferably, the indium on the carrier has a coating weight which lies in the range from 0.025 to 0.1 mg/cm. If the coating weight is below 0.025 mg/cm, too little indium remains on the carrier for achieving a sufficiently fast increase in the light output after a few thousands of burning hours owing to ageing processes. A coating weight higher than 0.1 mg/cm releases an excess quantity of mercury when the lamp is switched on. The optimum mercury pressure is then exceeded to the extent that a deep trough of long duration arises in the light output.

It is favourable for the simplicity of the manufacturing process when the alloy of indium and mercury is provided on the carrier via an interposed nickel layer.

The elongate carrier is, for example, a metal tape. A wire, however, is more flexible and is accordingly preferred as the carrier.

An attractive embodiment of the electrodeless low-pressure mercury discharge lamp according to the invention is characterized in that the wire has a longitudinal zone which extends substantially parallel to the tube and in addition has a bend on either side of a plane which passes centrally through the tube and through the longitudinal zone, said longitudinal zone and said bends being tangent to the tube. This embodiment of the carrier can be provided comparatively easily in the tube. In a modification, the wire has a helical portion which is enclosed in the tube with clamping force instead of the construction described above.

BRIEF DESCRIPTION OF THE DRAWIMGS

Figure 2:
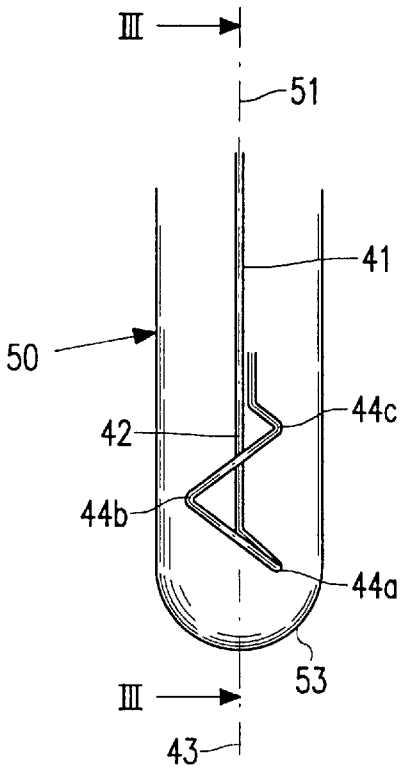
FIG. 2 shows a detail thereof viewed along II in FIG. 1.
Figure 3:
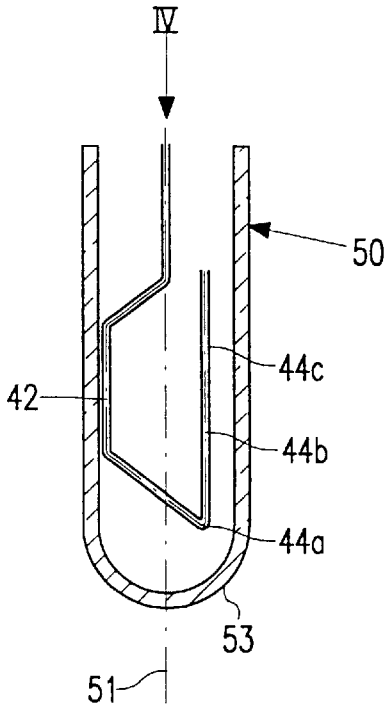
Figure 4:
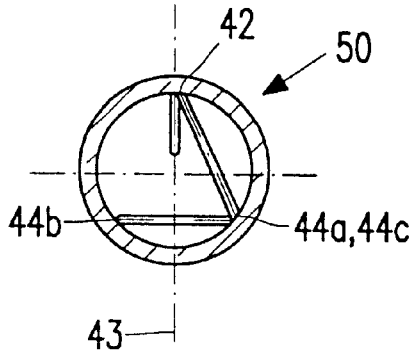
Figure 8:
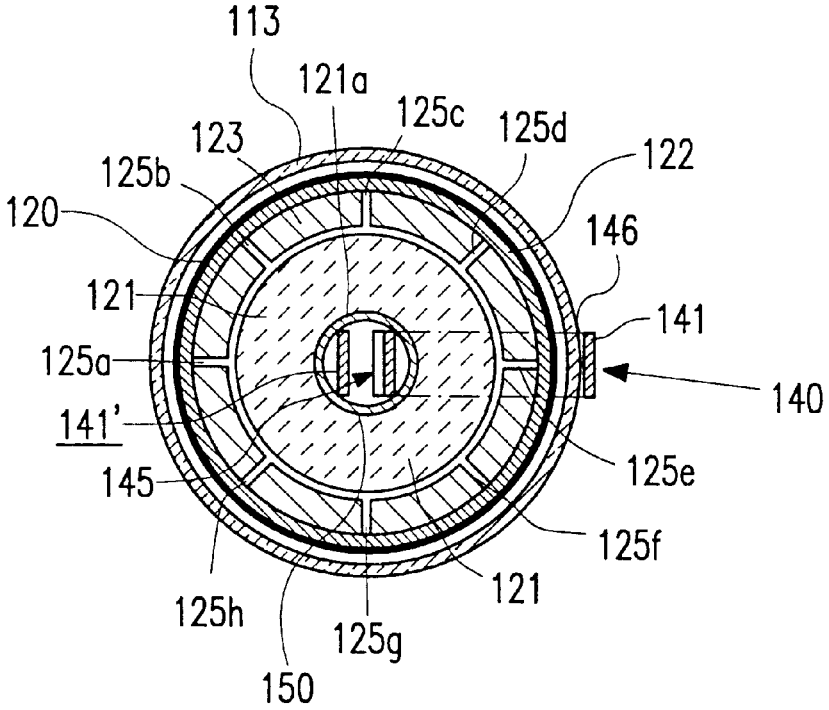
Figure 5A:
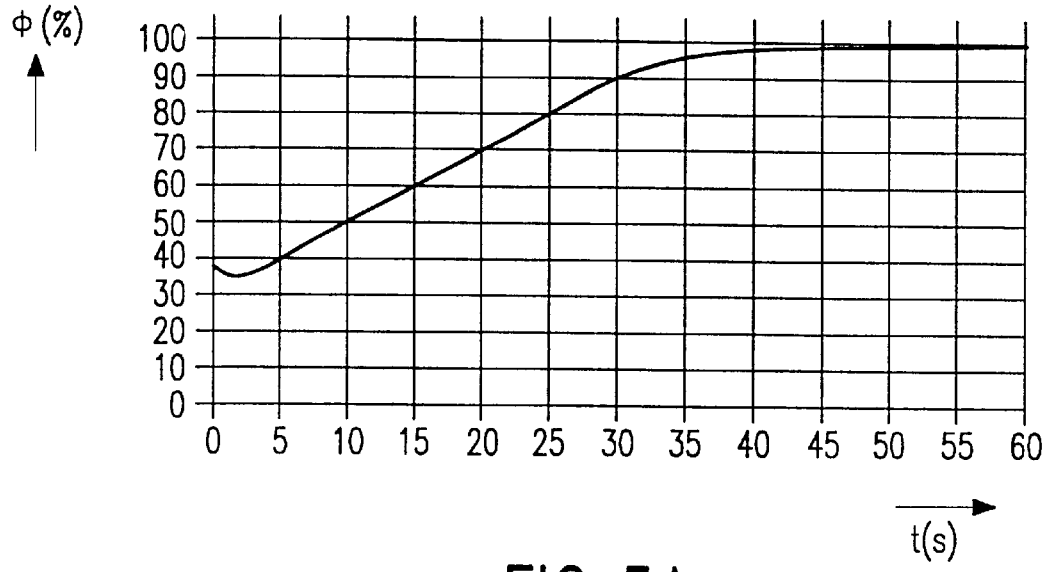
Figure 5B:
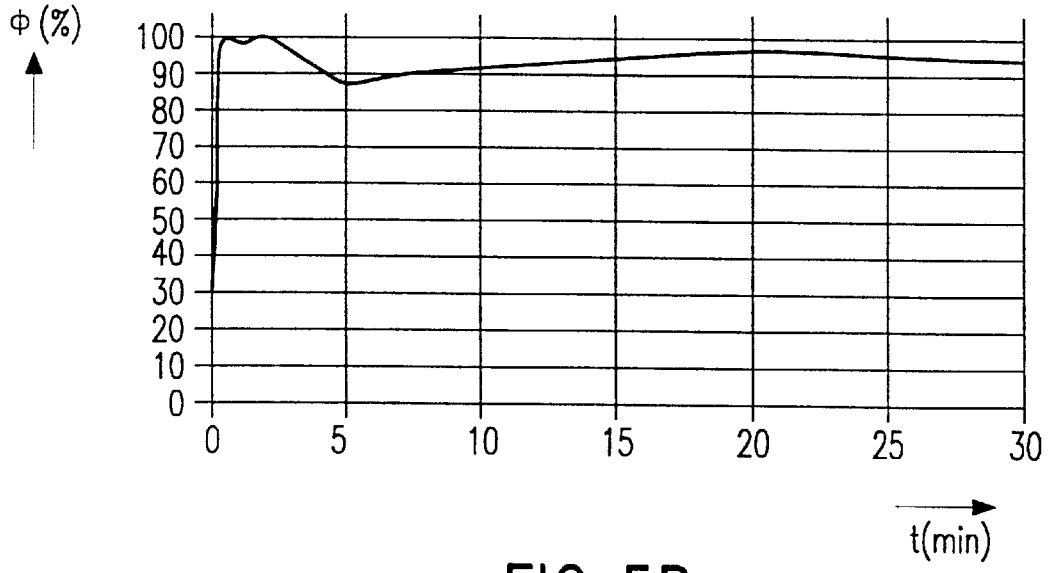
Figure 6A:
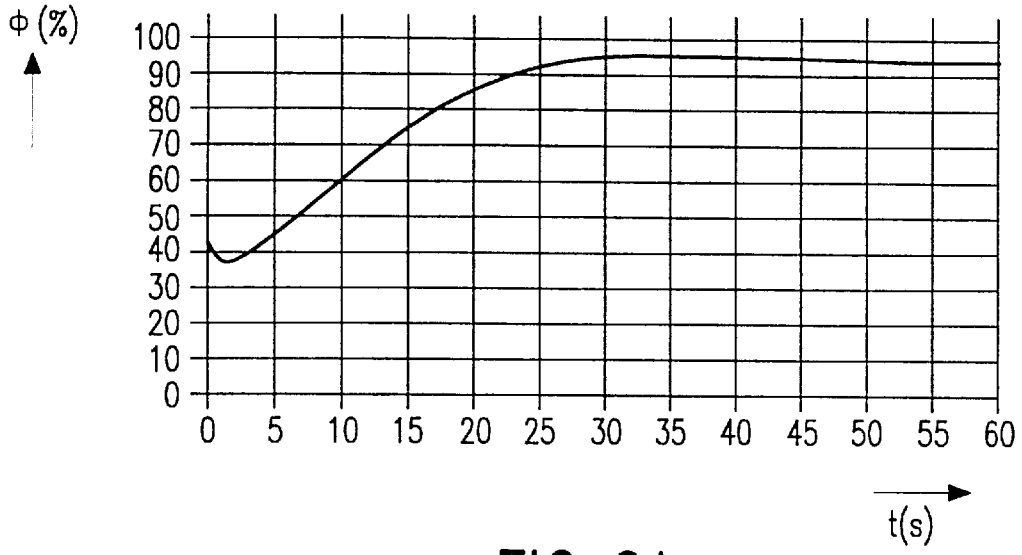
Figure 6B:
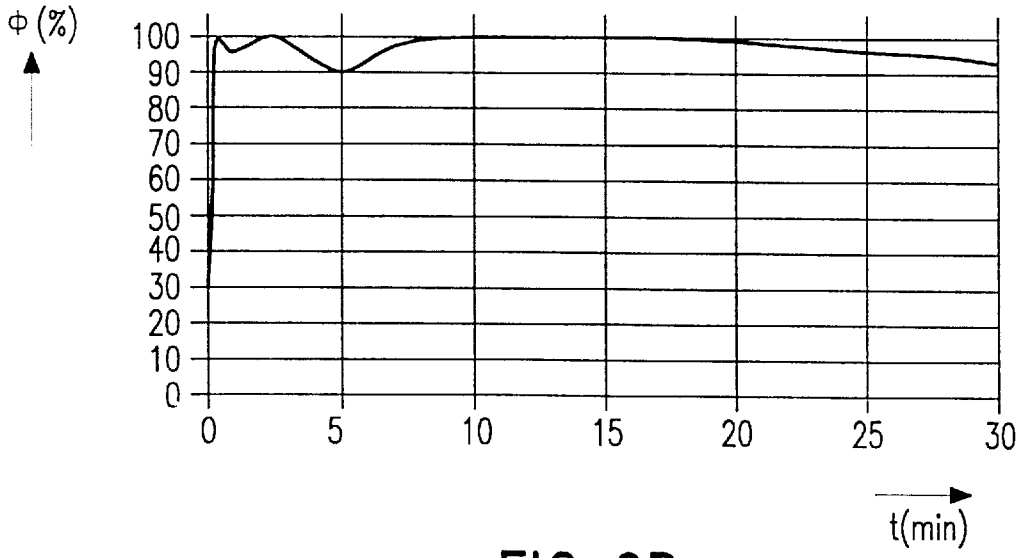
Figure 7:
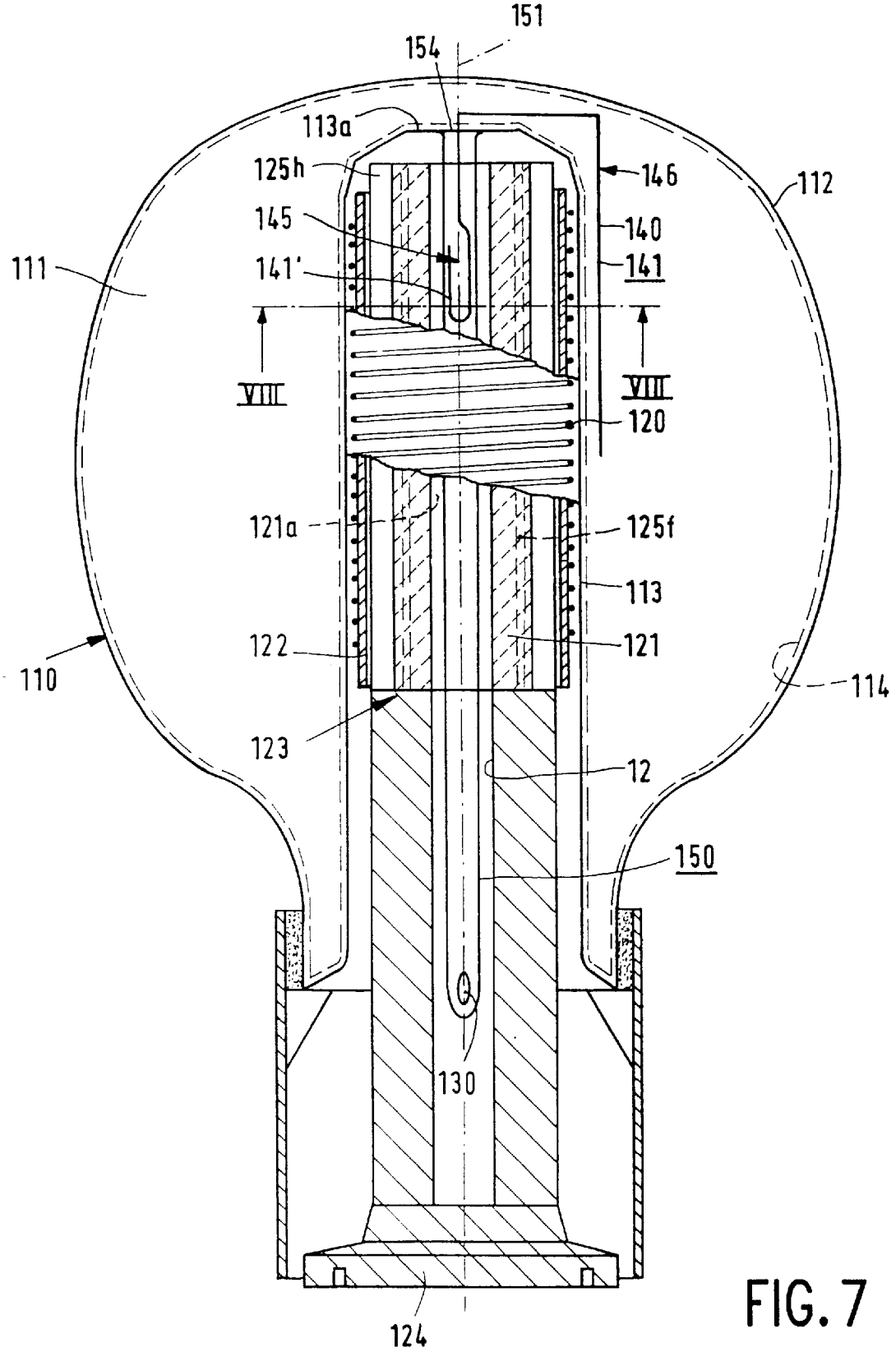

FIG. 3 shows this detail in a longitudinal sectional view taken on the line III—III in FIG. 2, FIG. 4 is an elevation of the detail viewed along IV in FIG. 3, FIGS. 5A and 5B show the light output $\phi$ as a function of time t in a first version of the first embodiment, FIGS. 6A and 6B show the light output $\phi$ as a function of time t in a second version of the first embodiment, FIG. 7 shows a second embodiment in longitudinal sectional view, and FIG. 8 is a cross-section taken on the line VIII—VIII in FIG. 7.

DETAILED DESCRIPTION OF THE PREFERRED EMBODIMENTS

Figure 1:
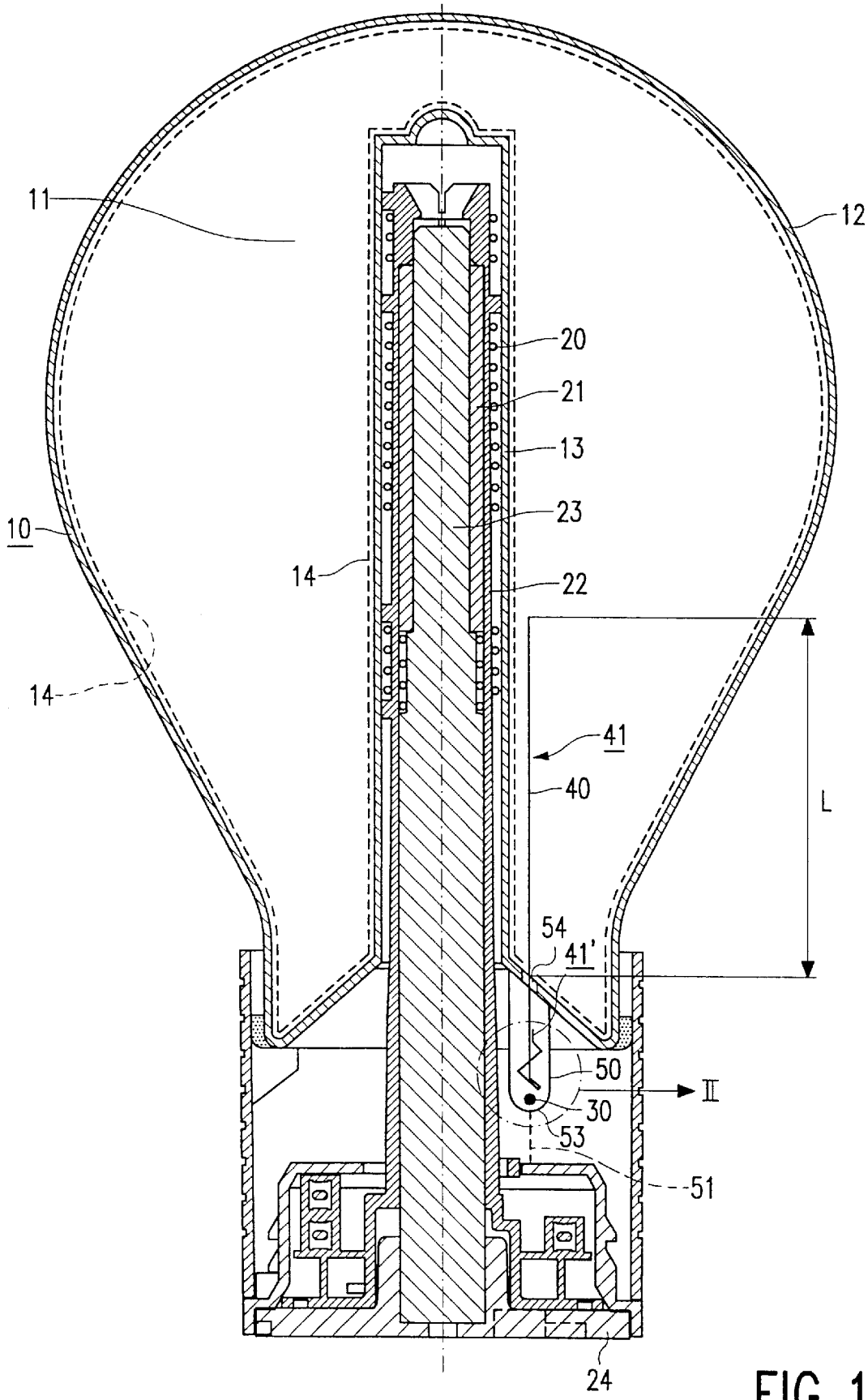
FIG. 1 shows a first embodiment in longitudinal sectional view.

FIG. 1 shows an electrodeless low-pressure mercury discharge lamp provided with a light-transmitting discharge vessel 10 which encloses a discharge space 11 in a gastight manner. The discharge space 11 contains mercury and also argon and krypton. The discharge vessel 10 of the lamp shown has an enveloping portion 12 and a recessed portion 13. A synthetic-resin coil former 22 supporting an electric coil 20 is provided in the recessed portion 13 around a hollow core 21 of soft magnetic material. A high-frequency magnetic field which maintains an electric discharge in the discharge space is generated in the discharge space 11 by the electric coil 20 during operation. UV radiation generated thereby is converted into visible radiation by a luminescent layer 14. The hollow core 21 surrounds a metal body 23 which extends to outside the recessed portion 13 and has a flange 24 there. The discharge lamp is provided with a main amalgam 30 and with an auxiliary amalgam 40. The auxiliary amalgam 40 is provided on an elongate carrier 41 which is mechanically coupled to a tube 50 which issues into the discharge space, next to the recessed portion 13 in this case. The tube has an axis 51. The auxiliary amalgam 40 covers substantially the entire carrier 41. The main amalgam 30 is provided in the lamp separately from the carrier 41, in this case in an end 43 of the tube 50 facing away from the discharge space. The main amalgam 30 is $Bi_{68}In_{29}Hg_3$ (in % by weight). The elongate carrier 41 in the embodiment shown is an iron wire of 0.6 mm thickness. The auxiliary amalgam 40 is an amalgam of indium and mercury. The auxiliary amalgam 40 is provided on a nickel layer of 0.1 $\mu$m thickness (not shown). In the embodiment shown, the carrier 41 projects from the tube 50 into the discharge space 11. The wire 41 has a longitudinal zone 42 which extends substantially parallel to the tube 50 (see also FIGS. 2–4). Furthermore, the wire 41 has bends 44*a*, 44*b* on either side of a plane 43 which passes centrally through the tube and through the longitudinal zone 42. The longitudinal zone 42, the bends 44*a*, 44*b*, and a further bend 44*c* form part of a bend portion 41' of the wire. The bend portion 41' is enclosed inside the tube 50 between a narrowed mouth 54 and the end 53 of the tube facing away from the discharge space. The wire 41 is mechanically coupled to the tube 50 in this manner. In addition, the wire 41 is fastened with clamping fit, i.e. with friction, in the tube 50, such that the longitudinal zone 42, the bends 44*a*, 44*b*, and the further bend 44*c* touch the tube 50. The carrier 41 can be easily applied in this embodiment even if the recessed portion 13 has already been fastened to the enveloping portion 12 of the discharge vessel 10, provided the tube 50 is still open at its end 53 facing away from the discharge space 11. The carrier 41 is then pushed into the tube 50 at end 53. Subsequently, this end 53 of the tube 50 may be closed, for example by fusion.

Several versions were made of lamps in accordance with the embodiment shown in FIGS. 1 to 4. The coating weight of the auxiliary amalgam 40 on the wire 41 and the length L over which the wire 41 projects into the discharge space 11 were varied here. FIGS. 5A and 5B show the light output $\phi$ in % of the nominal light output as a function of time t in s and in min in a first version. In this version, the length L is 40 mm and the coating weight of the indium on the wire 0.05 mg/cm. For a second version, where the length L is 50 mm, the light output $\phi$ is shown in FIGS. 6A and 6B. The lamp exhibits the desired switching-on behaviour in both cases. A light output amounting to 70% of the nominal value is reached within 60 s. This level is reached after 20 and 14 s in the first and the second version, respectively, of the lamp. The luminous decrement resulting from an excess quantity of mercury in the vapour phase is 12 and 10%, respectively. So the light output remains higher than 80% in both cases.

Comparatively major variations in lamp behaviour occur when the carrier is shifted, for example owing to vibrations, in the case of a length below 40 mm. In the case of a length above 60 mm, the amalgam present on the portion extending into the discharge space becomes too hot during operation, and a black deposit may be formed on the wall of the discharge vessel.

A second embodiment of the lamp according to the invention is shown in FIGS. 7 and 8. Components therein corresponding to those of FIG. 1 have reference numerals which are 100 higher. The tube 150 in which the elongate carrier 141 is fastened has a mouth 154 at an end 113*a* of the recessed portion 113 facing the discharge space 111. The tube extends through a cavity 121*a* of a core 121 of soft magnetic material. A metal body 123 is furthermore accommodated in the recessed portion 113 and surrounds the cylindrical core. The circumference of the metal body is interrupted around the cylindrical core by longitudinal slots 125*a–h*. The electric coil 120 is provided around a sleeve 122 of synthetic resin which surrounds the metal body. The auxiliary amalgam 140, for example tin, is provided here on a piece of stainless steel taping. This tape is fastened with friction in the tube 150 in that a first U-shaped portion 145 thereof is enclosed in the tube 150 with clamping fit. The elongate carrier 141 has a second U-shaped portion 146 which extends from the first portion 145 to the mouth 154 of the tube, then radially away from the axis 151, and subsequently parallel to the axis 151 next to the recessed portion 113 of the discharge vessel. The alloy $Bi_{67}In_{28}Hg_5$ (in % by weight) serves as the main amalgam 130.

We claim:

1. An electrodeless low-pressure mercury discharge lamp provided with a light-transmitting discharge vessel (10; 110) which encloses a discharge space (11; 111) in a gastight manner, which discharge space comprises mercury and one or several rare gases, said lamp being in addition provided with an electric coil (20; 120) for generating a high-frequency magnetic field in the discharge space, and said discharge lamp being provided with an auxiliary amalgam (40; 140) which is applied to an elongate carrier (41; 141) which is mechanically coupled to a tube (50; 150) issuing into the discharge space, wherein the auxiliary amalgam (40; 140) covers the carrier (41; 141) at least substantially entirely, and wherein the carrier is a wire having a longitudinal zone (42) which extends substantially parallel to the tube (50) and in addition has a bend (44*a*, 44*b*) on either side of a plane (43) which passes centrally through the tube and through said longitudinal zone, said longitudinal zone and said bends being tangent to the tube.

2. An electrodeless low-pressure mercury discharge lamp as claimed in claim 1, characterized in that the tube (50) and the elongate carrier (41) are mechanically coupled in that the elongate carrier (41) has a bend portion (41') which is enclosed inside the tube (50).

3. An electrodeless low-pressure mercury discharge lamp as claimed in claim 1 wherein the elongate carrier (41; 141) is fastened in the tube (50; 150) by frictional forces.

4. An electrodeless low-pressure mercury discharge lamp as claimed in claim 1 wherein the carrier (41; 141) projects from the tube (50; 150) into the discharge space (11; 111).

5. An electrodeless low-pressure mercury discharge lamp as claimed in claim 1 wherein the auxiliary amalgam (40) is an alloy of mercury and indium.

6. An electrodeless low-pressure mercury discharge lamp as claimed in claim 5, characterized in that said alloy is provided on the carrier (41) via an interposed nickel layer.

7. An electrodeless low-pressure mercury vapor discharge lamp comprising a discharge vessel comprising an enveloping portion and a recessed portion located centrally in said enveloping portion and fixed to said enveloping portion to enclose a discharge space in said discharge vessel, a metal body located centrally in said recessed portion, an electric coil surrounding said metal body in said recessed portion for generating a high frequency magnetic field in said discharge space, a tube fixed to said discharge vessel outside of said discharge space, said tube having a closed end remote from the discharge space and communicating with said discharge space via a mouth, an elongate carrier having bends which provide a frictional fit inside said tube, said carrier extending through said mouth into said discharge space, and an auxiliary amalgam which is applied to the elongate carrier.

8. An electrodeless low-pressure mercury vapor discharge lamp as in claim 7 wherein said auxiliary amalgam at least substantially covers said carrier.

9. An electrodeless low-pressure mercury vapor discharge lamp as in claim 7 further comprising a main amalgam in said tube.

10. An electrodeless low-pressure mercury vapor discharge lamp as in claim 7 wherein said auxiliary amalgam is an alloy of mercury and indium.

11. An electrodeless low-pressure mercury vapor discharge lamp as in claim 7 further comprising a layer of nickel on said carrier between said carrier and said auxiliary amalgam.

12. An electrodeless low-pressure mercury vapor discharge lamp as in claim 7 wherein said carrier is a wire.

13. An electrodeless low-pressure mercury vapor discharge lamp as in claim 12 wherein said wire comprises a longitudinal zone which extends substantially parallel to the tube and a bend on either side of a plane which passes centrally through said tube and through said longitudinal zone, said longitudinal zone and said bends being tangent to said tube.

* * * * *